United States Patent [19]

Faintuch et al.

[11] 3,948,525

[45] Apr. 6, 1976

[54] CHANCE CONTROLLED MATCHING GAME

[76] Inventors: Hart T. Faintuch; Mimi K. Faintuch, both of 686 Spring Road, Elmhurst, Ill. 60126

[22] Filed: Oct. 29, 1974

[21] Appl. No.: 518,499

[52] U.S. Cl. ... 273/135 AC; 273/135 AA; 273/150; 273/DIG. 26

[51] Int. Cl.[2] ..... A63F 3/00

[58] Field of Search... 273/131 AB, 134 AD, 134 C, 273/134 D, 135 R, 135 AC, 135 AA, 137 B, 137 C, 137 D, 157 R

[56] References Cited

UNITED STATES PATENTS

| | | | |
|---|---|---|---|
| 2,549,708 | 4/1951 | Post | 273/135 AC |
| 2,881,537 | 4/1959 | Dreman | 273/137 D |
| 3,608,902 | 9/1971 | Weisbecker | 273/134 AD |
| 3,638,947 | 2/1972 | Hardesty | 273/135 AC |
| 3,677,549 | 7/1972 | Moscovich | 273/137 D |

*Primary Examiner*—Richard J. Apley
*Assistant Examiner*—Harry G. Strappello
*Attorney, Agent, or Firm*—Neuman, Williams, Anderson & Olson

[57] ABSTRACT

A game of combined chance and judgment is disclosed wherein a plurality of gaming pieces are employed on a gaming field in cooperative combination with a plurality of dice and a set of cards, each of which cards identifies one or more of the gaming pieces. Distinctive field designations on the respective faces of the gaming pieces are matched with each other on the gaming field based upon card selections and the results of tosses of the dice.

15 Claims, 26 Drawing Figures

Figure 8A:
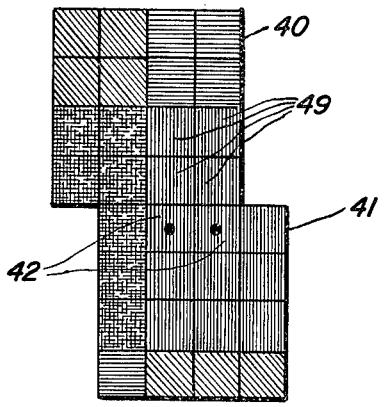

FIG. 1
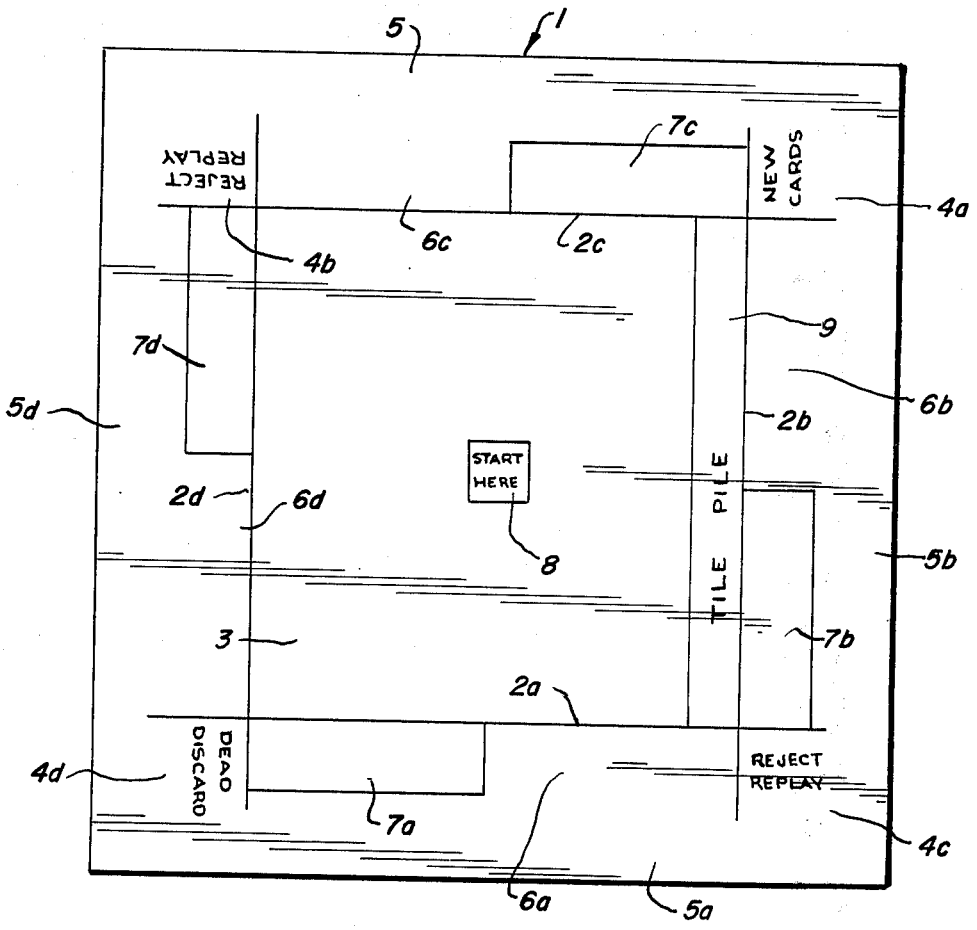
FIG. 2a
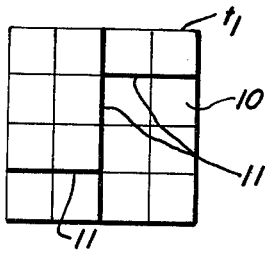
FIG. 2b
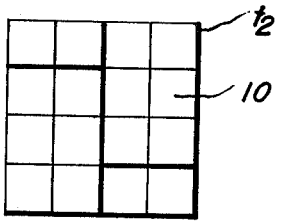
FIG. 2c
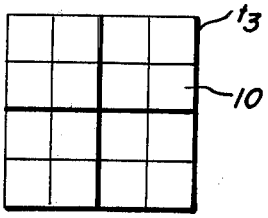
FIG. 2d
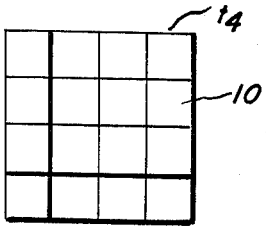
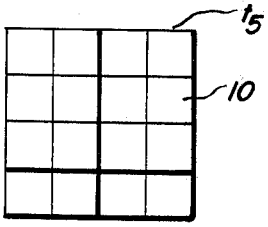
FIG. 2e FIG. 3a
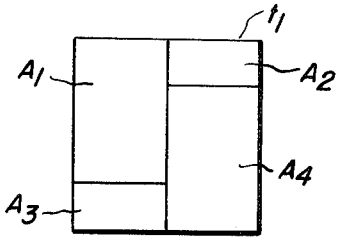
FIG. 3b
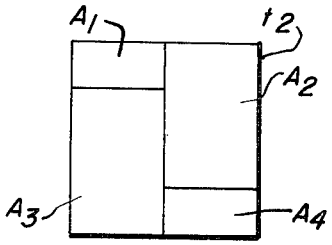
FIG. 3c
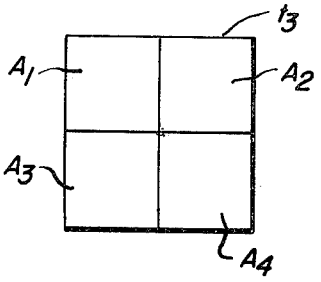
FIG. 3d
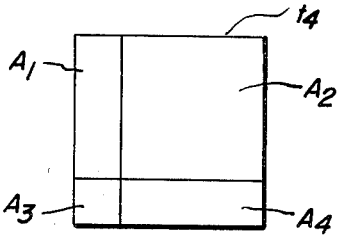
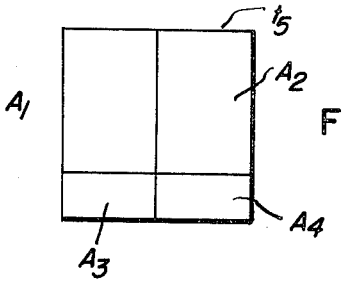
FIG. 3e
FIG. 4a
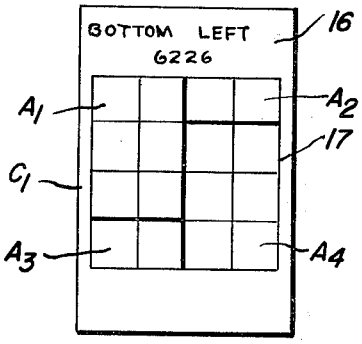
FIG. 4b
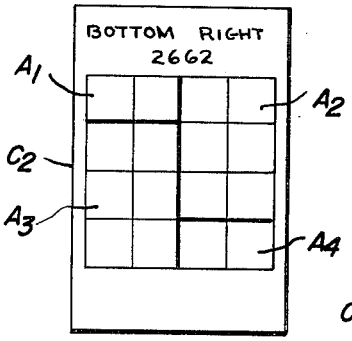
FIG. 4c
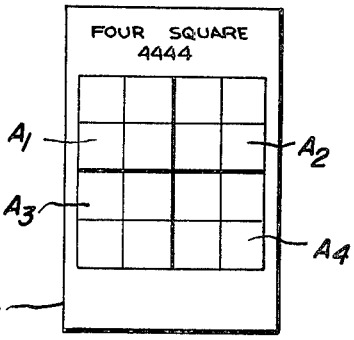
FIG. 4d
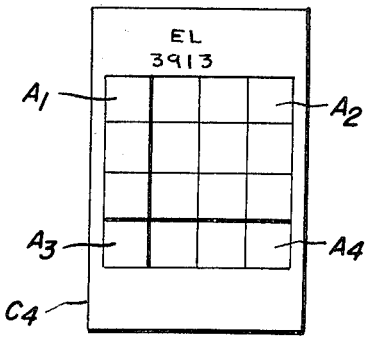
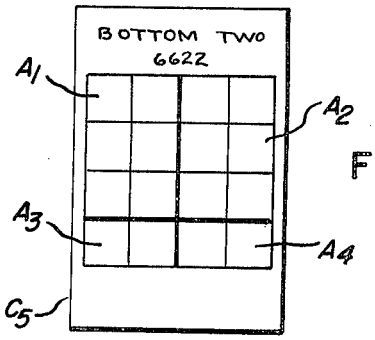
FIG. 4e FIG. 5a
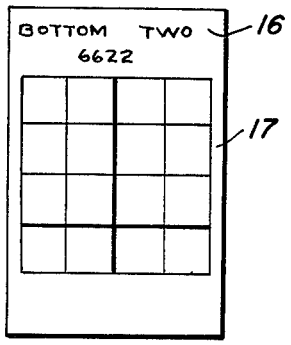
FIG. 5b
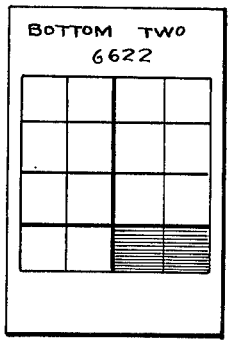
FIG. 5c
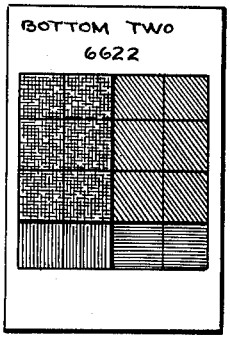
FIG. 6a
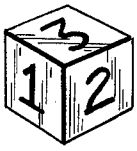
FIG. 6b
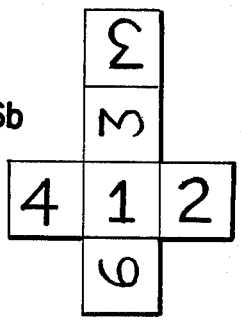
FIG. 7a
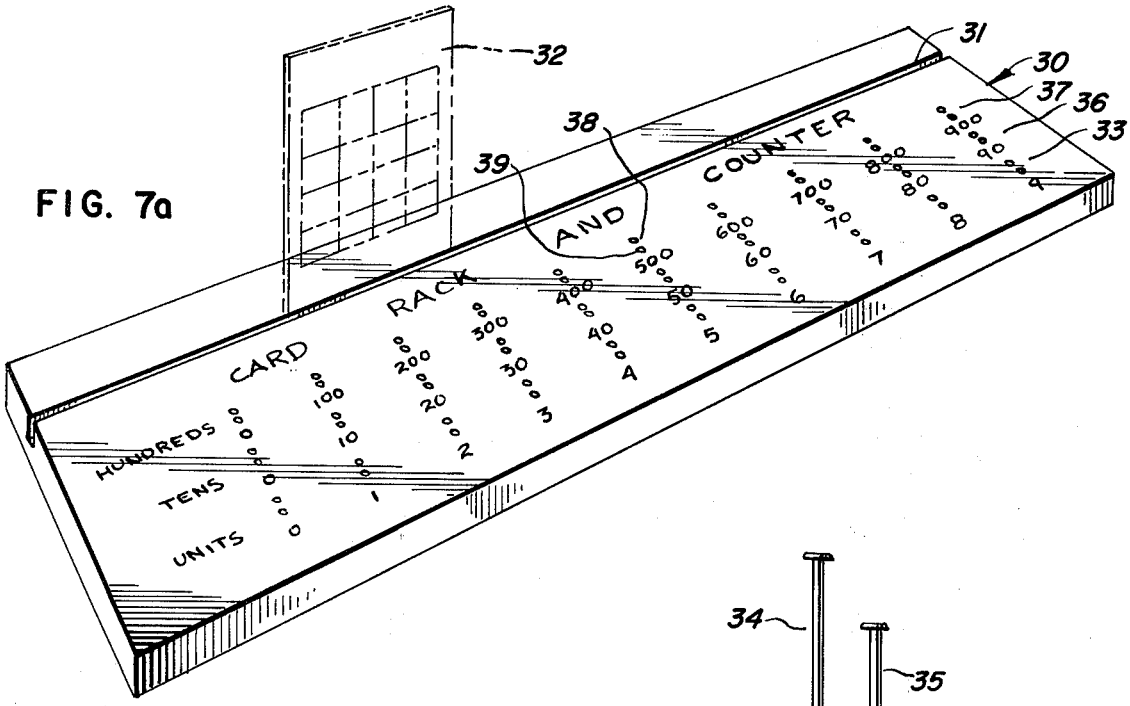
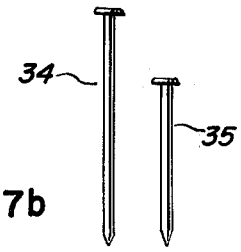
FIG. 7b

CHANCE CONTROLLED MATCHING GAME

This invention relates to a game and more particularly to a game employing both chance and judgment in the matching of an individual player's gaming pieces to those of other players.

It is an object of the game to provide a playing field whereon an individual player places gaming pieces according to the outcome of a chance event and in accordance with his considered judgment.

It is a further object of the invention to provide a game wherein a player matches new and improved gaming pieces, each including a plurality of preferably planar segments divided into distinctively coded groups with other such gaming pieces according to coding and numbers or segments.

It is yet another object of the invention to provide chance devices, such as dice, for selecting the numbers of segments of particular coded groups to be matched by a player.

These and yet additional objects and features of the invention will become apparent in the detailed discussion below.

In the preferred form of the game of the present invention described below, each player, of two or more, selects a plurality of gaming pieces. Each of the gaming pieces includes, on one planar surface, a plurality of segments selectively grouped and color-coded. Each player also receives a plurality of cards, each of which describes a single gaming piece or a class of gaming pieces. Finally, each player, in turn, employs a plurality of dice, equal in number to the number of colors on said gaming pieces, to specify a particular number of segments in each respective group of segments. It is the object of the game for a player to match one or more of his gaming pieces corresponding to a class specified by one of his cards with a gaming piece already on a gaming field. The matching process requires a matching of color-coded groups including numbers of segments at least equal to the number specified by a corresponding one of the dice.

For a complete understanding of this invention, reference should be made to the accompanying drawings in which:

FIG. 1 is a plan view of one embodiment of the playing field;

FIGS. 2*a* through 2*e* are plan views of typical gaming pieces employed in the game showing the segments and groups of through into which one surface of each of the pieces is divided;

FIGS. 3*a* through 3*e* are plan views of the divided areas of the gaming pieces shown in FIGS. 2*a* throug 2*e*, each of the subletter designations corresponding to the same subletter designation in FIGS. 2*a* through 2*e;*

FIGS. 4*a* through 4*e* are plan views of typical cards employed by a player to identify individual gaming pieces or classes of pieces shown in FIGS. 2*a* through 2*e* and FIGS. 3*a* through 3*e;*

FIGS. 5*a* through 5*c* are top plan views of playing cards showing possible variations of color coding for the gaming pieces and cards of the type shown in FIGS. 2*e* and 4*e*, respectively;

FIGS. 6*a* and 6*b* are views of a typical die used in the game, FIG. 6*b* being an unfolded view of the six faces of the die shown in FIG. 6*a;*

FIGS. 7*a* and 7*b* show a view of a card rack and counting board, together with pins used therein, provided to a player using the playing field, gaming pieces, cards and die shown in FIGS. 1 through 6*b;*

Figure 8B:
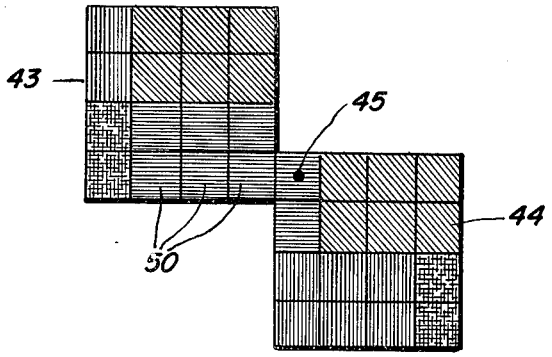
Figure 8C:
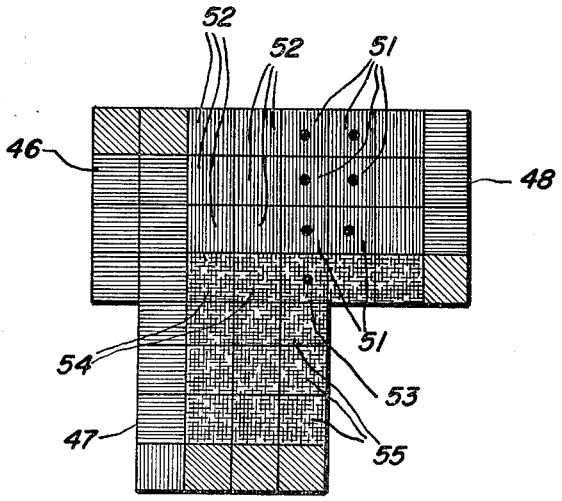

FIGS. 8*a* through 8*c* show various illustrative matching combinations of the gaming pieces shown in FIGS. 2*a* through 2*e* and 3*a* through 3*e*with color-coding added to the faces of the pieces.

More specifically, an illustrative embodiment of the aforementioned gaming field is shown at 1 in FIG. 1. It can be seen therein that parallel to each edge of the rectangular, preferably square, gaming field 1, demarcation lines 2*a* through 2*d* are included a selected distance within the gaming field and running substantially parallel to the edges of the entire surface. Within the four demarcation lines (lines 2*a* through 2*d*) there is a common area 3, wherein gaming pieces are placed by the players, and outside of the common area, adjacent the intersections of the demarcation lines, is a plurality of other areas around the periphery of the gaming field. The peripheral area 4*a* labeled "New Cards" is an area wherein cards yet to be used by the players are stored. The areas 4*b* 4*c*, labeled "Reject, Replay," are areas where cards used by the players, but still subject to play, are stored. The area 4*d*, labeled "Dead Discard" is an area where cards which have been played, but are not subject to replay, are stored.

The areas 5*a* through 5*d*, comprising the outer portions of areas around the periphery of the gaming field, each lying substantially between two of the parallel lines bounding the common area 3 (such as the area 5*a* located between demarcation lines 2*b* and 2*d*, for example) are appropriate areas in which each player may store his tiles which ultimately may be played on the common area 3. The areas 6*a* through 6*d*, which are to each player's right lying outside of the common area 3 but adjacent thereto and along the inner portion of the above-mentioned peripheral areas defined by the lines 2*a* through 2*d* are used for tile storage or for card racks and counters assigned to each individual player and described below. The areas 7*a* through 7*d* to each player's left outside of and along the margin of the common area 3 are appropriate to display information such as rules of the game, game designation, name of manufacturer, or they may also be used as locations for placing the card racks and counters of the individual players. The "Start Here" field 8 located in the center of the common area 3 is a point at which an initial gaming piece is placed at the beginning of the game. In the area 9, labeled "Tile Pile" within the common area 3, tiles yet to be selected and played by each player may be stored.

The gaming pieces are illustrated in FIGS. 2*a* through 2*e*. It can be seen therein, specifically in FIG. 2*a*, that the gaming piece $t_1$, referred to hereinafter as tile $t_1$, includes a number of segments 10, all of equal size, across a planar surface of the tile. The tile itself may be made of cardboard, wood, plastic or ceramic or other suitable material; however, cardboard is deemed preferable. The segments of the tile are divided into groups, as shown by the dividing lines 11. These dividing lines are purely illustrative and do not, in fact, appear on the tile since the groups are color-coded and no dividing line other than the color-coding is required. It can be seen, however, that a plurality of configurations of groups is possible. Specifically, in FIG. 2*a*, tile $t_1$, when viewed in a manner reading left to right, first across the top of the tile and then across the bottom of the tile, is configured with a group of six segments in the upper left corner, a group of two segments in the upper right corner, another group of two segments in the lower left corner, and a final group of six segments in the lower right corner. In FIG. 2*b* it can be seen that the tile $t_2$ has in the upper left corner a group of two segments, then to the right, a group of six segments, in the lower left corner a group of six segments, and in the lower right corner a group of two segments. Tile $t_3$ in FIG. 2*c* has four groups of four segments. Tile $t_4$ in FIG. 2*d* has a group of three segments in the upper left corner, a group of nine segments in the upper right corner, a group of one segment in the lower left corner, and a group of three segments in the lower right corner. Tile $t_5$, shown in FIG. 2*e*, has a group of six segments in the upper left corner and a group of six segments in the upper right corner, together with a group of two segments in each of the lower left and lower right corners.

While the tiles $t_1$ through $t_5$ are divided into sixteen of the segments 10, the invention is not limited to such a division; rather, the number of segments could be 3, 9, 25, or more. Also, the tiles could be rectangular rather than square, and other geometric configurations of both the tiles and the groups of segments on the tiles are possible.

The tiles are shown in FIGS. 3*a* through 3*e* with four areas, i.e., upper left corner, upper right corner, lower left corner, and lower right corner, into which varying numbers of segments are grouped, identified by area designations $A_1$ through $A_4$, respectively. Specifically, for the tile $t_1$, shown in FIG. 3*a*, the group in the upper left corner, including six segments for this particular tile in FIG. 2*a*, is identified as area $A_1$; the area shown in FIG. 3*a* in the upper right corner of the tile $t_1$, including two segments for this particular tile, is identified as area $A_2$; the area in the FIG. 3*a* in the lower left corner, including two segments, is labeled $A_3$; and finally, the area in the lower right corner of tile $t_1$ in FIG. 3*a*, including six segments, is labeled $A_4$. In like manner, in FIG. 3*b*, the similar areas are also labeled $A_1$, $A_2$, $A_3$, and $A_4$, in correspondence with the groups of segments in the upper left corner, the upper right corner, the lower left corner and the lower right corner for the tile $t_2$. The other tiles illustrated in FIGS. 2*c* through 2*e* are shown in FIGS. 3*c* through 3*e* with the respective groups of segments labeled as above described.

As mentioned above, the respective areas or groups of segments of the tiles or gaming pieces are preferably color-coded. The colors selected may be any combination of colors which is pleasing to the human eye. The specific colors selected in the preferred embodiment are red, blue, green and yellow. With this selection of colors, and on the basis that no color is repeated on any one tile, twenty-four combinations of colors are available, and as a result, a maximum of twenty-four uniquely color-coded tiles for each group configuration is possible. More specifically, as shown in the chart below, the areas $A_1$, $A_2$, $A_3$, and $A_4$ may assume the following sets of colors on any one tile:

| $A_1$ | $A_2$ | $A_3$ | $A_4$ |
|---|---|---|---|
| Red | Blue | Green | Yellow |
| Red | Blue | Yellow | Green |
| Red | Green | Blue | Yellow |
| Red | Green | Yellow | Blue |
| Red | Yellow | Blue | Green |
| Red | Yellow | Green | Blue |
| Blue | Red | Green | Yellow |
| Blue | Red | Yellow | Green |
| Blue | Green | Red | Yellow |
| Blue | Green | Yellow | Blue |
| Blue | Yellow | Red | Green |

-continued

| $A_1$ | $A_2$ | $A_3$ | $A_4$ |
|---|---|---|---|
| Blue | Yellow | Green | Red |
| Green | Blue | Red | Yellow |
| Green | Blue | Yellow | Red |
| Green | Red | Blue | Yellow |
| Green | Red | Yellow | Blue |
| Green | Yellow | Red | Blue |
| Green | Yellow | Blue | Red |
| Yellow | Red | Blue | Green |
| Yellow | Red | Green | Blue |
| Yellow | Blue | Red | Green |
| Yellow | Blue | Green | Red |
| Yellow | Green | Red | Blue |
| Yellow | Green | Blue | Red |

Even though 24 unique color combinations for each of the tiles $t_1$ through $t_5$ are available, the group configurations on some of the tiles are not amenable to fully utilizing all such combinations to produce uniquely color coded tiles. For example, when tile $t_1$, having areas labeled as in FIG. 3*a*, is rotated 180°, the group configuration appears the same as in FIG. 3 *a* but area $A_2$ is in the position occupied previously by area $A_3$ and area $A_4$ is in the position previously occupied by area $A_1$. This rotational ambiguity of the group configuration of tile $t_1$ reduces the number of unique color combinations which are uniquely identifiable irrespective of rotation of the tile $t_1$ to 12, one-half of the possible 24. The same is true of tile $t_2$. However, tile $t_3$ presents a group configuration as shown in FIG. 3*c* with each 90° of rotation. Consequently, the number of uniquely color-coded tiles which are uniquely identifiable irrespective of rotation of the tile $t_3$ is only one-fourth of the 24 possible unique color combinations. When the tiles $t_4$ and $t_5$ are rotated, however, there is no point, other than full 360° of rotation, at which the same configurations shown in FIGS. 3*d* and 3*e*, respectively, are obtained. Thus, 24 uniquely color-coded tiles are possible for each of the tiles $t_4$ and $t_5$.

The total number of color-coded tiles in the preferred embodiment is eighty-four consisting of one set of 12 uniquely color-coded $t_1$ tiles, one set of twelve uniquely color-coded $t_2$ tiles, two sets of six uniquely color-coded $t_3$ tiles, one set of 24 uniquely color-coded $t_4$ tiles and one set of 24 uniquely color-coded $t_5$ tiles. Two sets of $t_3$ tiles are used to speed play.

Having above described two of the major elements of the inventive game, that is, the gaming field and the gaming pieces employed in the game, attention is now turned to the aforementioned cards which each player employs to identify one or more of the game pieces which he may use in playing the game. Specifically, cards representative of the cards employed in the game are shown in FIGS. 4*a* through 4*e*. It can be seen in FIG. 4*a* that the card $C_1$ is labeled at 16 "Bottom Left 6226." On the face of the card is included a representation 17 of a tile. The particular representation shown in FIG. 4*a* is that of the tile $t_1$ shown in FIG. 2*a*. It can be seen that the area $A_1$ on the card $C_1$ corresponds to the area $A_1$ of the tile $t_1$, as demonstrated in FIGS. 2*a*, 3*a* and 4*a*. The like correspondence of areas $A_2$, $A_3$ and $A_4$ is shown in FIGS. 2*a*, 3*a* and 4*a*.

The designation "Bottom Left" on card $C_1$ facilitates identification; "6226" corresponds to the number of segments in each area when the card is viewed left to right, i.e., six segments in the upper left corner corresponding to the segments in area $A_1$, two in the upper right corner corresponding to area $A_2$, two in the lower left corner corresponding to area $A_3$, and six in the lower right corner corresponding to area $A_4$. It can also be seen in FIGS. 4*b* through 4*e* that the other cards represented in those figures correspond to the tiles $t_2$, $t_3$, $t_4$ and $t_5$ of FIGS. 2*b* through 2*e*, respectively. Thus, each of these cards designates a particular class of tiles, that is, those tiles which have segments grouped as shown on the respective cards.

As mentioned earlier, however, the tiles also are color-coded; that is, the groups of segments on each tile are identified by specific colors. In the present invention, all of the cards specify the particular configurations of groups on the tiles, and some of the cards also specify one or more colors which must appear on a particular tile of the specified configuration to be a tile appropriate for playing. More specifically, variations of the card $C_5$ labeled "Bottom Two 6622" shown in FIG. 4*e* are illustrated in FIGS. 5*a* through 5*c*. In FIG. 5*a* the card $C_5$ is shown without color shading. Thus, the face of any tile showing a configuration with six segments in its upper left corner, six segments in its upper right corner, two segments in its lower left corner, and two segments in its lower right corner, satisfies the designation of the card shown in FIG. 5*a*. However, in FIG. 5*b*, the card shown is the same configuration as that in FIG. 5*a* but there is a blue color shading of the two segments in the lower right corner area. Thus, only those tiles which are both of the group configuration shown in FIG. 5*b* and also have blue color-coding for the lower right group of segments, satisfy the designation of the card shown in FIG. 5*b*.

A more extensive color-coding is also possible in order to provide a variety of cards which match, in varying degrees, the color-coding of the tiles previously described. Thus, the tiles may be depicted on the cards of the present game invention by configuration of segments or by combinations of segment configurations and color-coding. Specifically, in FIG. 5*c*, the same group configuration is shown as in FIG. 5*a*, but there are four different color-codings. In the present game, only a tile having the configuration of groups of segments shown on the card in FIG. 5*c* with the color-coding shown thereon satisfies the designation of the card. The importance of these color-codings and the group configuration definition of the cards will become more apparent in the subsequent discussion of the playing of the game.

One of the aforementioned dice is shown in FIG. 6*a*. The die is of a conventional cubical form having imprinted thereon a plurality of numbers, one number on each side. The number designation, however, is unique. More specifically, it can be seen in FIG. 6*b*, wherein the die is shown in blank, that the numbers 1, 3, 3, 2, 4 and 6 are included on the faces of the die. It is important to note that the number 6 is not designated with a bar beneath it, and accordingly, it may be read either as the number 6 or in its inverted form, as the number 9. Again, the significance of the die and this number format will become apparent in the subsequent discussion of the playing of the game. It is important to note, however, that there is one die for each color-coded group of segments in a configuration as above described; i.e., when there are four colored groups of segments on each tile, there are also four dice employed. Were there five groups of colored segments, five dice would be required.

FIG. 7*a* shows a card rack and score-counting board 30 which includes a groove 31 in the board appropriate for the insertion of the aforementioned cards. Thus, cards inserted in the groove stand as shown in phantom at 32 for use at appropriate times as will be explained below. The board 30 also contains rows of holes designated for the maintenance of a player's score. Specifically, in a "Units" row 33, holes are provided into which pins 34 and 35 of FIG. 7*b* may be inserted in correspondence with the number of units in the score of the player. Similarly, "Tens" and "Hundreds" rows, 36 and 37, respectively, are also provided for the insertion of the aforementioned pins to maintain the score of the player.

It is important to note that two holes 38 and 39 are provided in each row at each digit. In addition, it is important to note that the pins 34 and 35 are of different heights. Thus, it is possible to insert both the pin 34 and the pin 35 of FIG. 7*b* into, for example, holes corresponding to the digit 1 in the "Units" row 36 and distinguish between those two pins on the basis of height. This feature is employed by players when a number of rounds of the game are to be scored. More specifically, if, for example, after the first round the player has a score of 22, the pin 34 and the pin 35 are inserted in the holes in the "Tens" row 37 corresponding to "20." In addition, a pin 34 and a pin 35 are inserted in the holes in the Units row 36 corresponding to the digit 2. Thereafter, in the next round of play, as the player scores additional points, the taller pins 34 are moved in correspondence to the points scored in the round, while maintaining the shorter pins 35 as a reference point from which to count additional scores.

In playing the game for which the above-described pieces are provided, each player is assigned ten tiles similar in grouping of segments and color-coding to the tiles shown in FIGS. 2*a* through 2*e*. These tiles are placed face up in the player's area such as 5*a*. The player is also provided with five cards, such as those shown in FIGS. 4*a* through 4*e* and FIGS. 5*a* through 5*c*, by one of the players who is designated as the Dealer. Each player places his cards in the groove 31 of his own card rack and counter 30 (FIG. 7*a*), with the card rack and counter 30 in front of him in an area such as 7*a*, preferably. After the dealer has dispensed five cards to each player, the remainder of the cards are placed in a pile, face down, in the new card area 4*a* of the gaming field 1. The first player to play is the one to the left of the dealer. That player attempts to match his cards with one or more of his tiles. The matching of cards to tiles has been described above. If the player finds that he has one or more tiles matching a card, he places the card and all of the matching tiles on the gaming area 1 for all players to see. The tiles thus placed are candidates for matching with tiles already played and are referred to as candidate tiles.

At this point, assuming that the game is being played with the four colors used on the tiles as above described, the player tosses all four differently colored dice, also above described. The number appearing on the top surface of each die is used to specify the exact number of tile segments of the same color as that of the respective die, which must be used in matching the player's candidate tile or tiles with any tiles already played. While further correlation of tiles, dice and cards will be described hereinafter, it should be noted immediately that if there is a die-tile match when the dice are thrown, and no other tiles have been played, a candidate tile which matches a die may be placed on the "Start Here" area 8 of the gaming area 1. Thereafter, if the same player has additional candidate tiles which match the selected card, those tiles may be played also in accordance with the die-tile matching rules to be described. Of course, these additional tiles must be matched to the already-present tiles on the playing area 3.

It is important to note that only one toss of the dice is permitted for each card played by any particular player, irrespective of the number of tiles that the player attempts to play using that card. In addition, each time a tile is successfully played and matched to the tiles already played, the score is counted. The rules for counting score will be subsequently described also.

Having used the aforementioned card, the player places the card face down in the area 4*d*, labeled Dead Discard. The cards in this area are not to be replayed.

It should be noted that if the player tosses the dice, and no match with any of his candidate tiles results, the card which was previously displayed to the other players must be returned to the card rack and the unplayed tiles must be returned face up to his group of tiles. In addition, if the player has more than one card which matches one or more of his tiles, the entire playing process may be repeated one card at a time until all of the cards matching tiles in the possession of the player are played. With each additional card played, an additional throw of the dice is required. Moreover, as each card is played, it is thereafter discarded in the Dead Discard area 4*d* of the playing field 1.

If a player finds that he has no cards which match any of the tiles he possesses, the player has two options. The player may either exchange one of his tiles with one that was not previously selected by the other players and has been stored in the tile pile area 9 (FIG. 1) or he may select one of his cards to place face up in the Reject, Replay areas 4*b* or 4*c*. These cards then become available to other players for their selection in replenishing their supply of cards. It is important to note, however, that no player may have, at any time, more than five cards, and should a player have less than five cards, he can request the dealer to supply him with an additional card or cards to make a total of five in his possession or he may select a sufficient number of cards from the Reject, Replay areas 4*b* or 4*c*.

Play continues with each player taking his respective turn moving clockwise around the playing area 1. The round is complete when one player reaches or passes 100 points in score or when one player runs out of tiles. As many rounds as desired may be played. However, the number of rounds to be played is selected by common agreement at the beginning of the game. The player with the highest score at the end of the number of rounds initially chosen is the winner.

If more than one round is to be played, at the termination of the first round the following actions are taken to initiate the second round. Each player records his first round score by placing the aforementioned pins 34 and 35 shown in FIG. 7*b* in the appropriate holes of his card rack and counter 30 (FIG. 7*a*). All unplayed tiles are collected and placed in the tile pile area 9 on the gaming surface 1 (FIG. 1). Each player selects ten tiles from that area 9. All unplayed cards are returned to the New Card area 4*a* including from the Reject, Replay areas 4*b* and 4*c*. Cards in the Dead Discard area 4*d* are not moved, however, because tiles corresponding to them have been played. The cards collected in the "New Card" area and still available for play are mixed and dealt out again, the dealer giving each player five new cards. Play resumes as above described for the first round. The game is ultimately ended when, as mentioned above, the chosen number of rounds has been completed or too few tiles remain in the tile pile area 9 to begin a new round due to the number of tiles played in previous rounds.

As mentioned earlier, there are four dice. Each of these dice is of the same color as one of the colors used on the tiles. Thus, in the color scheme previously described, the four dice are red, yellow, blue, and green. When the dice are tossed, four numbers thus appear, one number on each of the four dice. The possible numbers are the following 1, 2, 3, 4, 6 or 9. The numbers read from the dice specify the minimum number of segments on the face of a tile which must appear in a group colored in accordance with the die for the group segments to be employed in tile matching. For example, if the number 4 appears on the red die, a tile having a group of two red segments may not be used for tile matching. A tile having a group of four red segments may be used, however. Also a tile having six red segments may be used for such matching, but only four of the segments need be matched to another tile. More specifically, only four of the segments are "eligible" segments for matching. The number of segments in a group may be parallel to or perpendicular to one edge of the tile.

In performing tile matching, those tiles already played on the common area 3 are referred to as receiver tiles and those tiles which are to be matched to the tiles on the common area 3 are referred to as donor tiles. To be a donor tile eligible for consideration in the matching process, the tile must first match, as above described, a card in the possession of the player and thus be a candidate tile. If such is the case, the tile must also match the results of a toss of the dice as above described. If the above requirements are met by a donor tile, the following rules determine if the donor tile matches a particular receiver tile:

1. the colors of the touching squares along the edges of both tiles must be, respectively, the same; and

2. all the eligible segments on the donor tile must be matched in color, number and position by segments on the receiver tile.

To illustrate these matching rules and their application, three examples are shown in the accompanying drawings. Specifically, in FIG. 8*a* tile 40 is therein considered to be the receiver tile, and tile 41 is the donor tile. If the red die produces a number 2, the segments 42 (designated by dots for representational purposes only) are eligible segments for matching with corresponding segments of the tile 40; and, in fact, a match does result because two of the red segments on tile 41 may be placed adjacent two red segments on tile 40. Similarly, in FIG. 8*b*, assuming the tile 43 to be the receiver tile, and the tile 44 to be the donor tile, if the blue die produces the number 1, the segment 45 is the only eligible segment for matching with a corresponding segment of the tile 43, and a match results because the blue segment in the corner of tile 44 may be placed adjacent the blue segment in the corner of tile 43. In a more complicated situation involving corner tiles 46 and 47, if the red die produces the number 6 and the yellow die produces the number 1, a match results between the donor tile 48 and both receiver tiles 46 and 47 because the six red segments on donor tile 48 may be placed adjacent the six red segments on receiver tile 46 and the one yellow segment on donor tile 48 may be placed adjacent one yellow segment of each of the receiver tiles 46 and 47. It must be borne in mind that regardless of any correspondence between the upturned faces of the disc resulting from a player's throw and the tiles which he has in his possession available for play, no matching can be done unless he has a card to match the tile which he wants to play.

In scoring a player's tile match, the following rules are preferably employed. For each segment color, for example, red, first add scores applicable to all eligible donor tile segments to scores applicable to all receiver tile segments perpendicular to the edge of the receiver tile touching the donor tile. Then total the scores for all segment colors on the donor and receiver tiles which are placed adjacent each other in the matching process. To illustrate the application of these scoring rules, and the interrelationship of the cards, dice and tiles, reference is again made to FIG. 8*a*. Assuming that all segment colors are assigned a point value of one, and without adding bonus points which might result from the card which a player uses, the resulting score produced by the match of tiles 40 and 41 is six. This score is reached by adding one point for each of the two eligible red donor segments 42 and one point for each of the four red receiver segments 49, all of which segments were actually matched by a player. In FIG. 8*b*, the resulting score is four, reached by adding one point for the one eligible blue donor segment 45 to three points for the three blue receiver segments 50, all of which were actually matched by the player. For the match shown in FIG. 8*c*, the resulting score is nineteen, reached by adding one point for each of the six eligible red donor segments 51, the corresponding six red receiver segments 52, the one eligible yellow donor segment 53, the two yellow receiver segments 54, the one eligible yellow donor segment 53, repeated, since it matched segments on two tiles, and the three yellow receiver segments 55. It should be noted that, in playing the game, a match on more than one side of a tile may be available, but scoring is grounded only upon the matching which a player actually makes.

The card used to select a donor tile to be played may also affect a player's score. Specifically, if the card is uncolored, the score resulting from the match is unchanged. If at least one color appears on the card, but less than four colors, the matching score is doubled, and if four colors appear on the card, the score is tripled. Moreover, the winner of each round receives an additional five points.

In the illustrative embodiment of the game described above there are 84 tiles, 196 cards and four dice. It is designed for participation by as many as eight players. Mathematically corresponding variations may be made in order to accommodate a greater or lesser number of tiles, cards, dice and players. However, the interrelationship of card-tile matching, die-tile matching and tile-tile matching will be readily apparent to those skilled in the art having the foregoing description in mind, and it is intended by the following claims to include all such modifications of the above-described embodiment as fall within the true spirit and scope of the invention.

What is clamed is:

1. A competitive game of combined chance and judgment comprising:

a plurality of gaming pieces for selective disposition adjacent one another, each of said pieces being divided into a plurality of segments forming a plurality of groups arranged in a plurality of configurations, each group of segments for a gaming piece being distinguishably identified and consisting of at least one segment; and a plurality of cards, each containing a designation of at least one of said configurations of said groups of segments, for specifying gaming pieces having respectively identical configurations of said groups of segments as candidates for selective disposition adjacent other gaming pieces.

2. A game in accordance with claim 1 wherein:

said distinctively identified groups of segments are uniquely colored; and at least one of said cards displays at least one of the unique colors of said gaming pieces.

3. A game in accordance with claim 2 further comprising:

a plurality of distinctively colored cubes, said colors being any one of the colors of said gaming pieces;

said cubes being inscribed wit symbols, one symbol per face.

4. A game in accordance with claim 3 wherein said symbols are 1, 2, 3, 3, 4, and 6.

5. A game in accordance with claim 1 further comprising:

a card rack and counter including a groove for receiving said cards to support said cards on one end; and a plurality of holes for use in score keeping; and a plurality of pins of at least two lengths for insertion in said holes of said card rack and counter.

6. A game in accordance with claim 4 further comprising:

a card rack and counter including a groove for receiving said cards to support said cards on one end; and a plurality of holes for use in score keeping; and a plurality of pins of at least two lengths for insertion in said holes of said card rack and counter.

7. A game in accordance with claim 2 further comprising a gaming board including a peripheral area suitable for placement of said cards before being played and at least one peripheral area suitable for placement of said cards after being played.

8. A game in accordance with claim 1 further comprising a gaming board including an area for storage of said gaming pieces not yet played.

9. A game in accordance with claim 6 further comprising a gaming board including a peripheral area suitable for placement of said cards before being played and at least one peripheral area suitable for placement of said cards after being played.

10. A game in accordance with claim 9 wherein said gaming board includes an area for storage of said gaming pieces not yet played.

11. A game in accordance with claim 1 further comprising means for chance selection of any one of a group of indicia, each identifying the number of segments in at least one of said groups of segments.

12. A game in accordance with claim 2 further comprising means for chance selection of any one of a group of indicia, each identifying the number of segments in at least one of said groups of segments, wherein said group of indicia comprises a plurality of related sub-groups of such indicia.

13. A game in accordance with claim 4 wherein said gaming pieces are congruent and said segments are mutually exclusive congruent segments.

14. A game in accordance with claim 6 wherein said plurality of gaming pieces are each congruent and partitioned into said plurality of segments, said segments being mutually exclusive, and said gaming pieces are substantially planar.

15. A game in accordance with claim 14 further comprising a gaming board including an area for storage of said gaming pieces not yet played and a peripheral area suitable for placement of said cards before being played and at least one peripheral area suitable for placement of said cards after being played and further including an area suitable for placement of an initial gaming piece.

* * * * *